US009490538B2

(12) United States Patent
Hsu et al.

(10) Patent No.: US 9,490,538 B2
(45) Date of Patent: Nov. 8, 2016

(54) PLANAR DUAL POLARIZATION ANTENNA AND COMPLEX ANTENNA

(71) Applicant: Wistron NeWeb Corporation, Hsinchu (TW)

(72) Inventors: Chieh-Sheng Hsu, Hsinchu (TW); Cheng-Geng Jan, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 83 days.

(21) Appl. No.: 14/700,150

(22) Filed: Apr. 30, 2015

(65) Prior Publication Data

US 2016/0036130 A1 Feb. 4, 2016

(30) Foreign Application Priority Data

Jul. 31, 2014 (TW) ..... 103126252 A

(51) Int. Cl.

*H01Q 1/48* (2006.01)
*H01Q 9/04* (2006.01)
*H01Q 5/378* (2015.01)

(52) U.S. Cl.

CPC ..... *H01Q 9/0407* (2013.01); *H01Q 5/378* (2015.01); *H01Q 9/0414* (2013.01); *H01Q 9/0457* (2013.01)

(58) Field of Classification Search

CPC .. H01Q 9/0457; H01Q 9/0414; H01Q 5/378; H01Q 9/04

See application file for complete search history.

(56) References Cited

U.S. PATENT DOCUMENTS 4,903,033 A * 2/1990 Tsao ..... H01Q 9/0414 343/700 MS
5,691,734 A * 11/1997 Davies ..... H01Q 9/045 343/795
5,706,015 A 1/1998 Chen
6,335,703 B1 1/2002 Chang
6,531,984 B1 * 3/2003 Johannisson ..... H01Q 9/0435 343/700 MS (Continued)

FOREIGN PATENT DOCUMENTS

CN 202363587 U 8/2012
TW 200818599 4/2008

OTHER PUBLICATIONS

S. Gao, L. W. Li, M. S. Leong, and T. S. Yeo, "A Broad-Band Dual-Polarized Microstrip Patch Antenna With Aperture Coupling" IEEE Transactions on Antennas and Propagation, vol. 51, No. 4, Apr. 2003, p. 898-900.

(Continued)

*Primary Examiner* — Khai M Nguyen
(74) *Attorney, Agent, or Firm* — Winston Hsu; Scott Margo

(57) ABSTRACT

A planar dual polarization antenna for receiving and transmitting at least one radio signal includes a first patch plate, a metal grounding plate and a first dielectric layer disposed between the first patch plate and the metal grounding plate. The metal grounding plate includes a first pattern slot and a second pattern slot symmetric with respect to a centerline of the first patch plate. A first rectangle and a second rectangle enclosing an angle constitute a shape of the first pattern slot. The first rectangle and the second rectangle meet at a pivot vertex.

14 Claims, 18 Drawing Sheets

(56) References Cited

U.S. PATENT DOCUMENTS

| | | | |
|---|---|---|---|
| 7,253,770 | B2 | 8/2007 | Yegin |
| 7,423,595 | B2 | 9/2008 | Säily |
| 7,432,862 | B2 | 10/2008 | Heyde |
| 8,564,484 | B2 | 10/2013 | Jan |
| 2007/0229359 | A1 | 10/2007 | Heyde |
| 2008/0266192 | A1 | 10/2008 | Tuttle |
| 2013/0063310 | A1 | 3/2013 | Mak |

OTHER PUBLICATIONS

Andrea Vallecchi and Guido Biffi Gentili, "A Shaped-Beam Hybrid Coupling Microstrip Planar Array Antenna for X-Band Dual Polarization Airport Surveillance Radars" Antennas and Propagation, 2007. EuCAP 2007. The Second European Conference on Nov. 11-16, 2007.

Kin-Lu Wong, "Compact and Broadband Microstrip Antennas", p. 125-128, Copyright 2002 John Wiley & Sons, Inc., 2002.

* cited by examiner

| | X | Y |
|---|---|---|
| m1 | 0.0000 | 10.5604 |
| m2 | -180.0000 | -0.7793 |
| m3 | -38.0000 | 7.5505 |
| m4 | 36.0000 | 7.5372 |
| m5 | -38.0000 | -8.7527 |

| | X | Y |
|---|---|---|
| m1 | 0.0000 | 10.7230 |
| m2 | -180.0000 | -1.0877 |
| m3 | -37.5000 | 7.7406 |
| m4 | 35.0000 | 7.7031 |
| m5 | -37.5000 | -9.5336 |

PLANAR DUAL POLARIZATION ANTENNA AND COMPLEX ANTENNA

BACKGROUND OF THE INVENTION

1. Field of the Invention

The present invention relates to a planar dual polarization antenna and a complex antenna, and more particularly, to a planar dual polarization antenna and a complex antenna of broadband, wide beamwidth, high antenna gain, better common polarization to cross polarization (Co/Cx) value, smaller size, and meeting 45-degree slant polarization requirements.

2. Description of the Prior Art

Electronic products with wireless communication functionalities, e.g. notebook computers, personal digital assistants, etc., utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate the trend for smaller-sized electronic products. Additionally, with the advance of wireless communication technology, electronic products may be configured with an increasing number of antennas. For example, a long term evolution (LTE) wireless communication system and a wireless local area network standard IEEE 802.11n both support multi-input multi-output (MIMO) communication technology, i.e. an electronic product is capable of concurrently receiving/transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality. Moreover, MIMO communication systems can employ techniques such as spatial multiplexing, beam forming, spatial diversity, precoding, etc. to further reduce signal interference and to increase channel capacity.

The LTE wireless communication system includes 44 bands which cover from 698 MHz to 3800 MHz. Due to the bands being separated and disordered, a mobile system operator may use multiple bands simultaneously in the same country or area. Under such a situation, conventional dual polarization antennas may not be able to cover all the bands, such that transceivers of the LTE wireless communication system cannot receive and transmit wireless signals of multiple bands. Therefore, it is a common goal in the industry to design antennas that suit both transmission demands, as well as dimension and functionality requirements.

SUMMARY OF THE INVENTION

Therefore, the present invention provides a planar dual polarization antenna to solve current technical narrow-beamwidth problems.

An embodiment of the present invention discloses a planar dual polarization antenna, for receiving and transmitting at least one radio signal, comprising a first patch plate; a metal grounding plate comprising a first pattern slot and a second pattern slot, wherein a first rectangle and a second rectangle enclosing an angle constitute a shape of the first pattern slot, the first rectangle and the second rectangle meet at a pivot vertex, and the first pattern slot and the second pattern slot are symmetric with respect to a centerline of the first patch plate; and a first dielectric layer disposed between the first patch plate and the metal grounding plate.

An embodiment of the present invention further discloses a complex antenna for receiving and transmitting at least one radio signal, comprising a first planar dual polarization antenna layer comprising a plurality of first patch plates; a metal grounding plate comprising a plurality of rectangular regions, wherein each rectangular region of the plurality of rectangular regions is disposed corresponding to one of the plurality of first patch plates, each rectangular region of the plurality of rectangular regions comprises a first pattern slot and a second pattern slot, a first rectangle and a second rectangle enclosing an angle constitute a shape of the first pattern slot, the first rectangle and the second rectangle meet at a pivot vertex, and the first pattern slot and the second pattern slot are symmetric with respect to a centerline of the first patch plate; and a first dielectric layer disposed between the first planar dual polarization antenna layer and the metal grounding plate.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
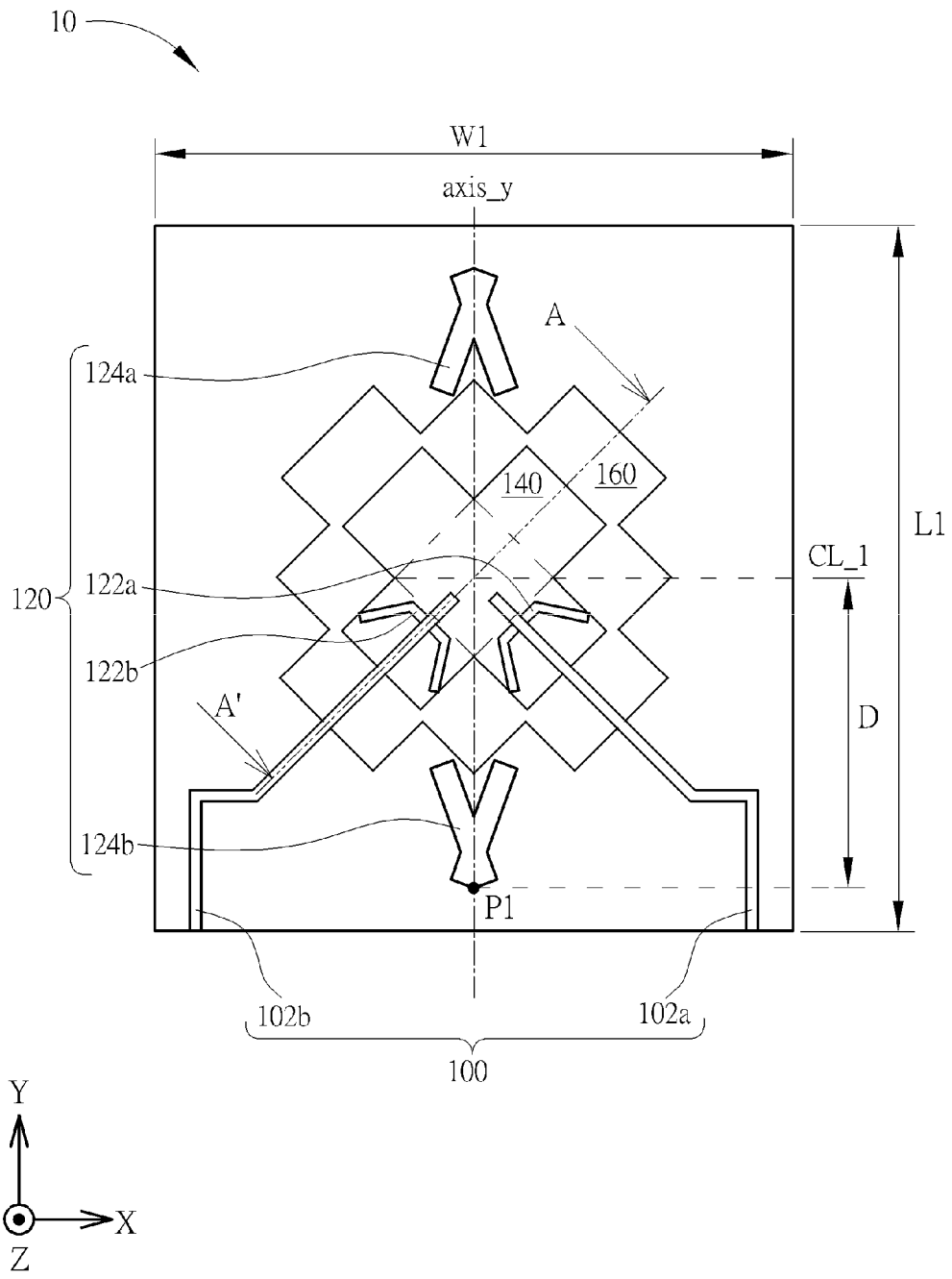
FIG. 1A is a top-view schematic diagram illustrating a planar dual polarization antenna according to an embodiment of the present invention.
Figure 1B:
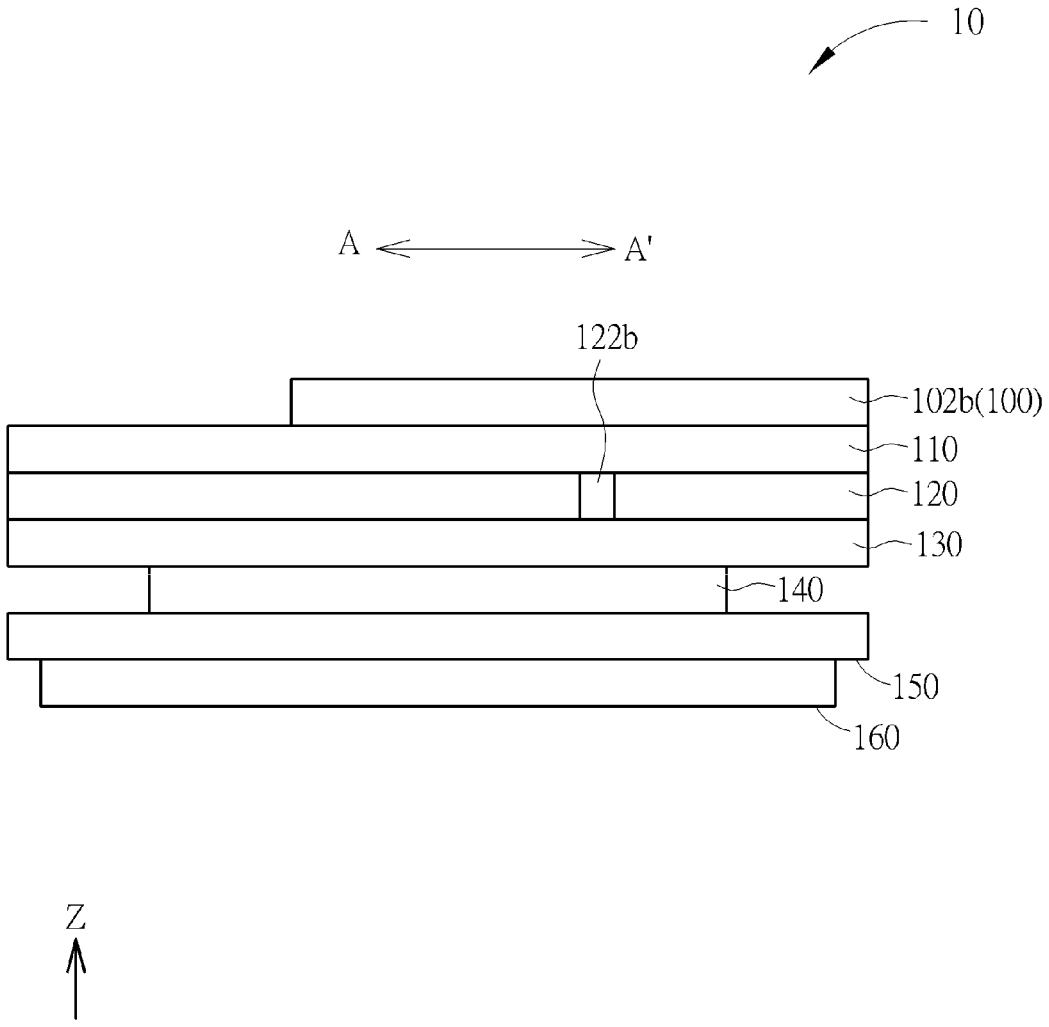
FIG. 1B is a cross-sectional view diagram of the planar dual polarization antenna taken along a cross-sectional line A-A' in FIG. 1A.

FIG. 1A is a top-view schematic diagram illustrating a planar dual polarization antenna 10 according to an embodiment of the present invention. FIG. 1B is a cross-sectional view diagram of the planar dual polarization antenna 10 taken along a cross-sectional line A-A' in FIG. 1A. The planar dual polarization antenna 10 is utilized to receive and transmit radio signals of a broad band or different frequency bands, such as radio signals in Band 40 and Band 41 of an LTE wireless communication system (Band 40: substantially 2.3 GHz-2.4 GHz, Band 41: substantially 2.496 GHz-2.690 GHz). As shown in FIGS. 1A and 1B, the planar dual polarization antenna 10 is substantially a seven-layered square architecture of reflection symmetry with respect to a symmetry axis axis_y and comprises a feeding transmission line layer 100, dielectric layers 110, 130, 150, a metal grounding plate 120 and patch plates 140, 160. The patch plate 140 is the main radiating body and has a shape substantially conforming to a cross pattern in order to generate electromagnetic waves with linear polarization but not circular polarization. The patch plate 160 is utilized to increase resonance bandwidth of the planar dual polarization antenna 10, and is electrically isolated from the patch plate 140 by the dielectric layer 150. In some embodiments, the center of the metal grounding plate 120, the center of the patch plate 140 and the center of the patch plate 160 are aligned to a centerline CL_1 of the patch plate 140, and the centerline CL_1 is disposed perpendicular to the symmetry axis axis_y. The feeding transmission line layer 100 comprises feeding transmission lines 102*a*, 102*b*, which are symmetric with respect to the symmetry axis axis_y and orthogonal to feed in radio signals of two polarizations. The metal grounding plate 120 is used for providing a ground and comprises slots 122*a*, 122*b* and pattern slots 124*a*, 124*b*. The slots 122*a*, 122*b* are orthogonal to the feeding transmission lines 102*a*, 102*b*, respectively. And, they are symmetry to the symmetry axis axis_y so as to generate an orthogonal dual-polarized antenna pattern.

Briefly, the length L1 of the metal grounding plate 120 along the symmetry axis axis_y is longer than the width W1 of the metal grounding plate 120 along the direction x, thereby increasing 3 dB beamwidth in the horizontal plane. The pattern slots 124*a*, 124*b* of the metal grounding plate 120 is utilized to balance the asymmetry of the length L1 and the width W1 and thus improve common polarization to cross polarization (Co/Cx) value.

Figure 2:
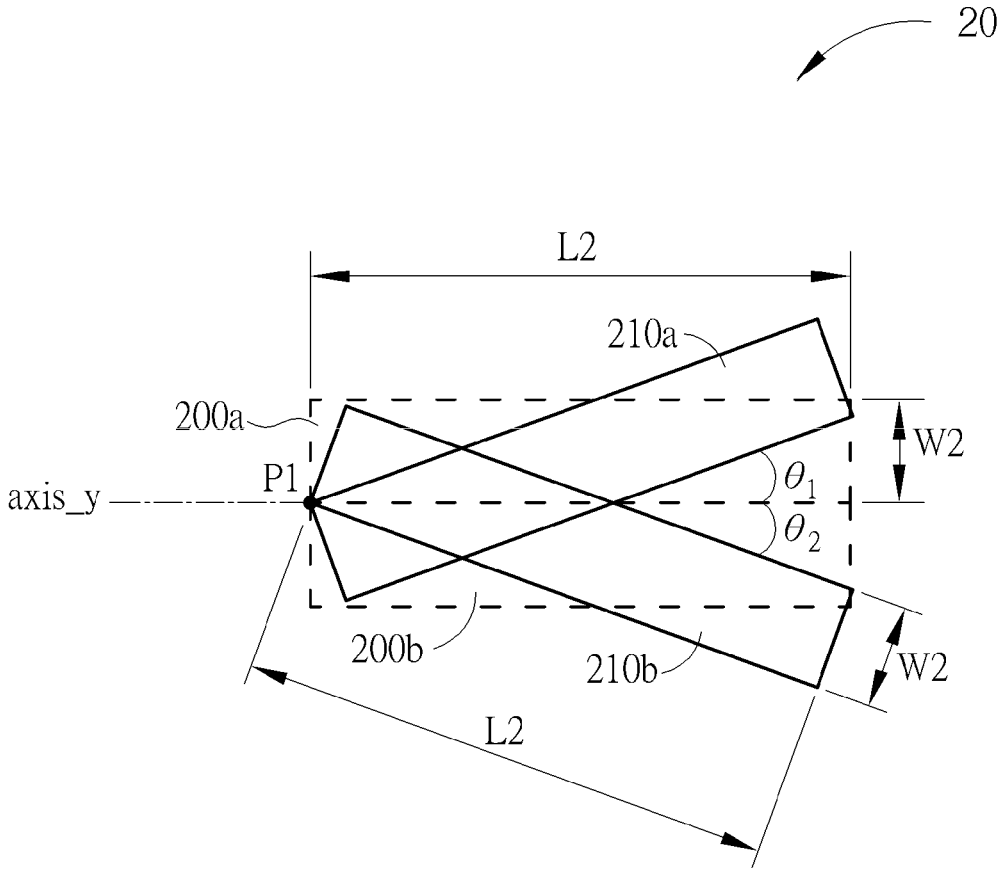
FIG. 2 is a schematic diagram illustrating a boomerang shape according to an embodiment of the present invention.

Specifically, to increase the beamwidth in horizontal plane (i.e., the xz plane), the width W1 of the metal grounding plate 120 along the direction x must be shortened to make the antenna pattern in horizontal plane diverge. It turns out that the length L1 of the metal grounding plate 120 along the symmetry axis axis_y is longer than the width W1 of the metal grounding plate 120 along the direction x. Since the length L1 is not equal to the width W1, resonance lengths in the vertical direction and in the horizontal direction will differ. The pattern slots 124*a*, 124*b* of the metal grounding plate 120, however, could balance the asymmetry due to the uneven quantities between the length L1 and the width W1. The pattern slots 124*a*, 124*b* substantially have a boomerang shape 20. Please refer to FIG. 2. FIG. 2 is a schematic diagram illustrating the boomerang shape 20 according to an embodiment of the present invention. Basically, to constitute the boomerang shape 20, rectangles 210*a*, 210*b* of identical shape and size meet at a pivot vertex P1 and enclose an angle. To provide a better understanding of the structure of the boomerang shape 20, one can image the rectangles 210*a*, 210*b* initially align with sides that overlap, and then respectively rotate tilt angles θ1, θ2 in the opposite direction from the symmetry axis axis_y with respect to the pivot vertex P1. The tilt angles θ1, θ2 may be 20°, but not limited herein. As shown in FIG. 1A and FIG. 2, the boomerang shape 20 is symmetric with respect to the symmetry axis axis_y, and the pattern slots 124*a*, 124*b* are disposed symmetrically with respect to the centerline CL_1 of the patch plate 140. Besides, since the dielectric layers 110, 130 are disposed to electrically isolate the feeding transmission line layer 100, the metal grounding plate 120 and the planar dual polarization antenna layer 140 from one another, the feeding transmission lines are coupled to the patch plate 140 by the slots of the metal grounding plate 120—that is to say, radio signals from the feeding transmission line (e.g., the feeding transmission line 102*a*) are coupled to the slot (e.g., the slot 122*a*), and then coupled to the patch plate 140 when the slot 122 resonates—to increase antenna bandwidth. The resonance direction of the patch plate 140 with a shape substantially conforming to a cross pattern tilts with respect to the metal grounding plate 120, and this effectively minimizes the dimensions of the planar dual polarization antenna 10 while meeting 45-degree slant polarization requirements.

Figure 3:
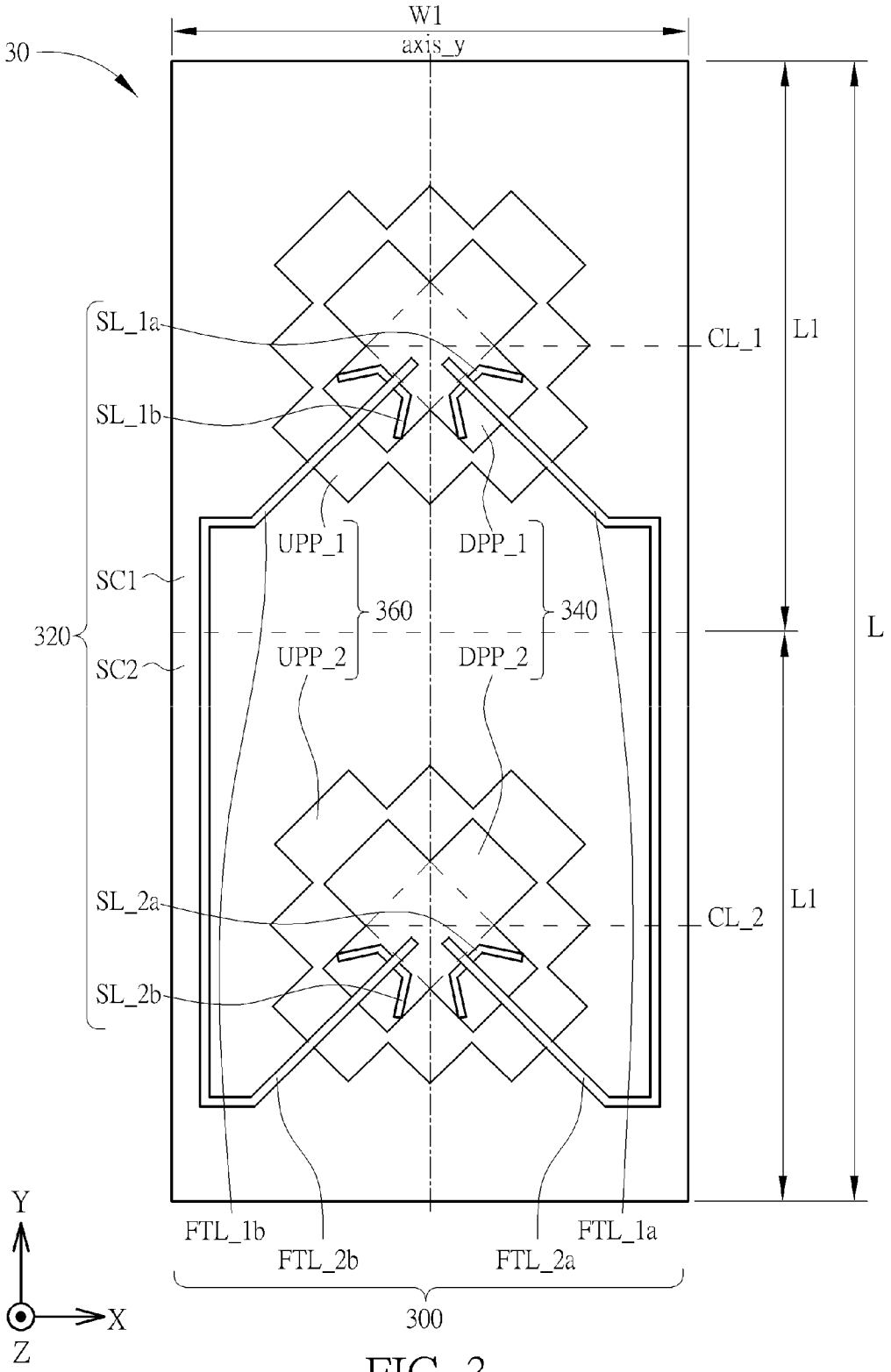
FIG. 3 is a top-view schematic diagram illustrating a complex antenna according to an embodiment of the present invention.

Please note that the planar dual polarization antenna 10 as shown in FIG. 1A and FIG. 1B is an exemplary embodiment of the invention, and those skilled in the art can make alternations and modifications accordingly. For example, to enhance antenna gain, the planar dual polarization antenna 10 may be arranged to form an array antenna. Please refer to FIG. 3. FIG. 3 is a top-view schematic diagram illustrating a complex antenna 30 according to an embodiment of the present invention. Similar to the planar dual polarization antenna 10, the complex antenna 30 is a seven-layered square architecture as well and comprises a feeding transmission line layer 300, three layers of dielectric layers (not shown), a metal grounding plate 320 and planar dual polarization antenna layers 340, 360. However, the planar dual polarization antenna layer 340 of the complex antenna 30 comprises patch plates DPP_1, DPP_2 with a shape substantially conforming to a cross pattern. The feeding transmission lines FTL_1*a*, FTL_1*b*, FTL_2*a*, FTL_2*b* of the feeding transmission line layer 300 are disposed respectively corresponding to the patch plates DPP_1, DPP_2 to feed in radio signals of two polarizations. The patch plate UPP_1, UPP_2 of the planar dual polarization antenna layer 360 are also disposed respectively corresponding to the patch plates DPP_1, DPP_2. The metal grounding plate 320 can be divided into rectangular regions SC1, SC2, and slots SL_1*a*, SL_1*b*, SL_2*a*, SL_2*b* on the rectangular regions SC1, SC2 are also disposed respectively corresponding to the feeding transmission lines FTL_1*a*, FTL_1*b*, FTL_2*a*, FTL_2*b*.

Technically, because an LTE base station is generally located near the ground, and because of the distance between an LTE base station and a user, the radiation power of the complex antenna 30 should be concentrated in vertical plane (i.e., the yz plane) within plus or minus 10 degrees elevation angle with respect to the horizon. In such a situation, the patch plates DPP_1, DPP_2 vertically aligned to form a 1×2 array antenna can ensure that antenna gain meets system requirements. Moreover, the length L1 of the rectangular regions SC1, SC2 along the symmetry axis axis_y is longer than the width W1 of the rectangular regions SC1, SC2 along the direction x, thereby increasing 3 dB beamwidth in horizontal plane (i.e., the xz plane). Table 1 is an antenna characteristic table for the complex antenna 30. As can be seen from Table 1, the complex antenna 30 meets LTE wireless communication system requirements for maximum gain and front-to-back (F/B) ratio. Furthermore, as the width W1 of the metal grounding plate 320 shrinks from 100 mm to 70 mm, the beamwidth in horizontal plane can increase to 69.5 to 73.0 degrees.

TABLE 1

| | | | | |
|---|---|---|---|---|
| the total length L of the metal grounding plate (mm) | 200 | 200 | 200 | 200 |
| the width W1 of the metal grounding plate (mm) | 100 | 90 | 80 | 70 |
| maximum gain (dBi) | 11.0-11.6 | 10.9-11.5 | 10.7-11.3 | 10.5-11.1 |
| front-to-back (F/B) ratio (dB) | 11.5-12.7 | 11.4-12.4 | 11.4-12.7 | 10.1-11.1 |
| 3 dB beamwidth in horizontal plane | 62.5°-65.5° | 64.0°-68.5° | 68.0°-70.5° | 69.5°-73.0° |
| common polarization to cross polarization (Co/Cx) value in horizontal plane (dB) | 19.0-22.0 | 17.4-20.5 | 16.0-18.3 | 13.6-16.8 |
| common polarization to cross polarization (Co/Cx) value in vertical plane (dB) | 22-29 | 20-29 | 18-29 | 14-28 |

Figure 4A:
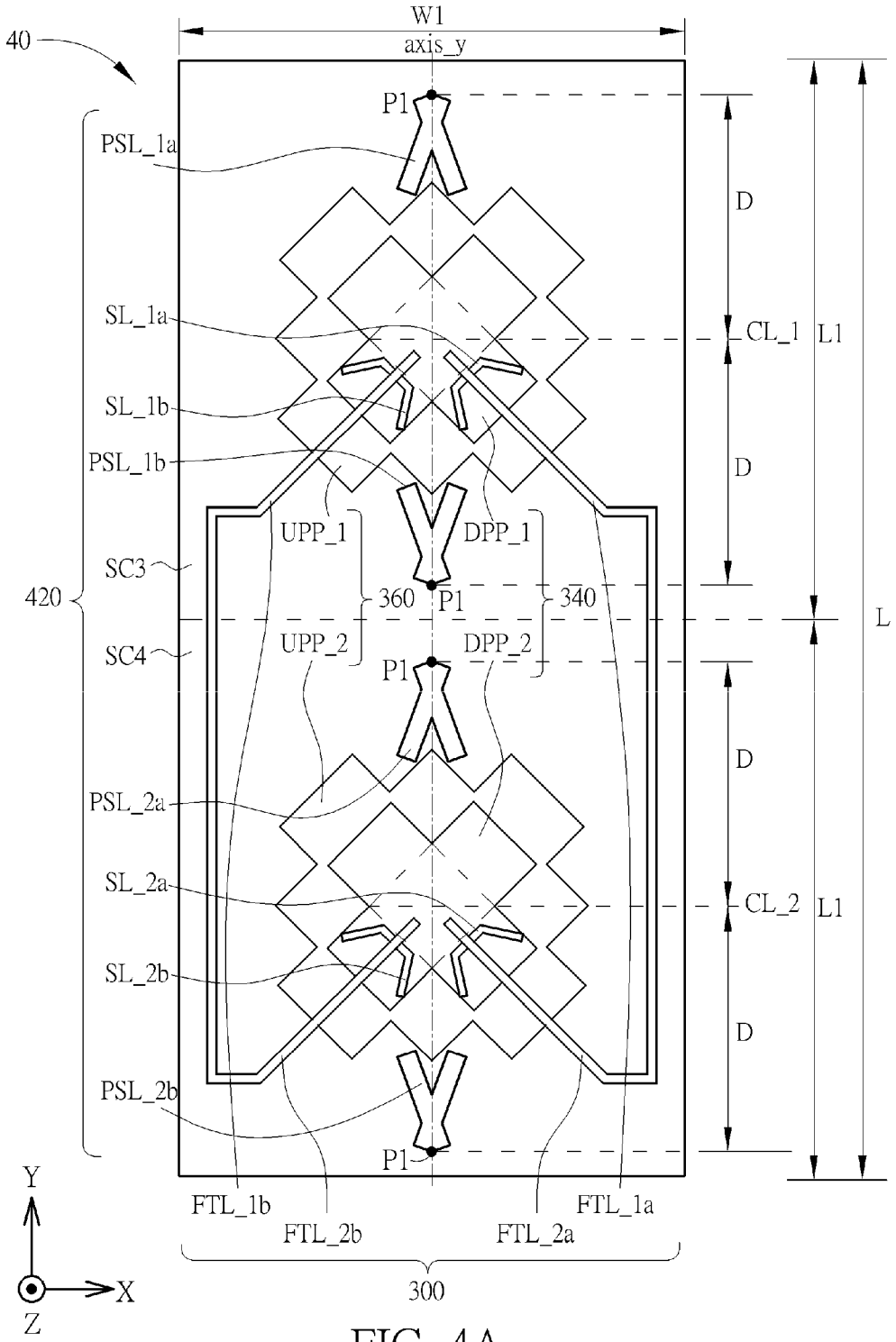
FIG. 4A is a top-view schematic diagram illustrating a complex antenna according to an embodiment of the present invention.
Figure 4B:
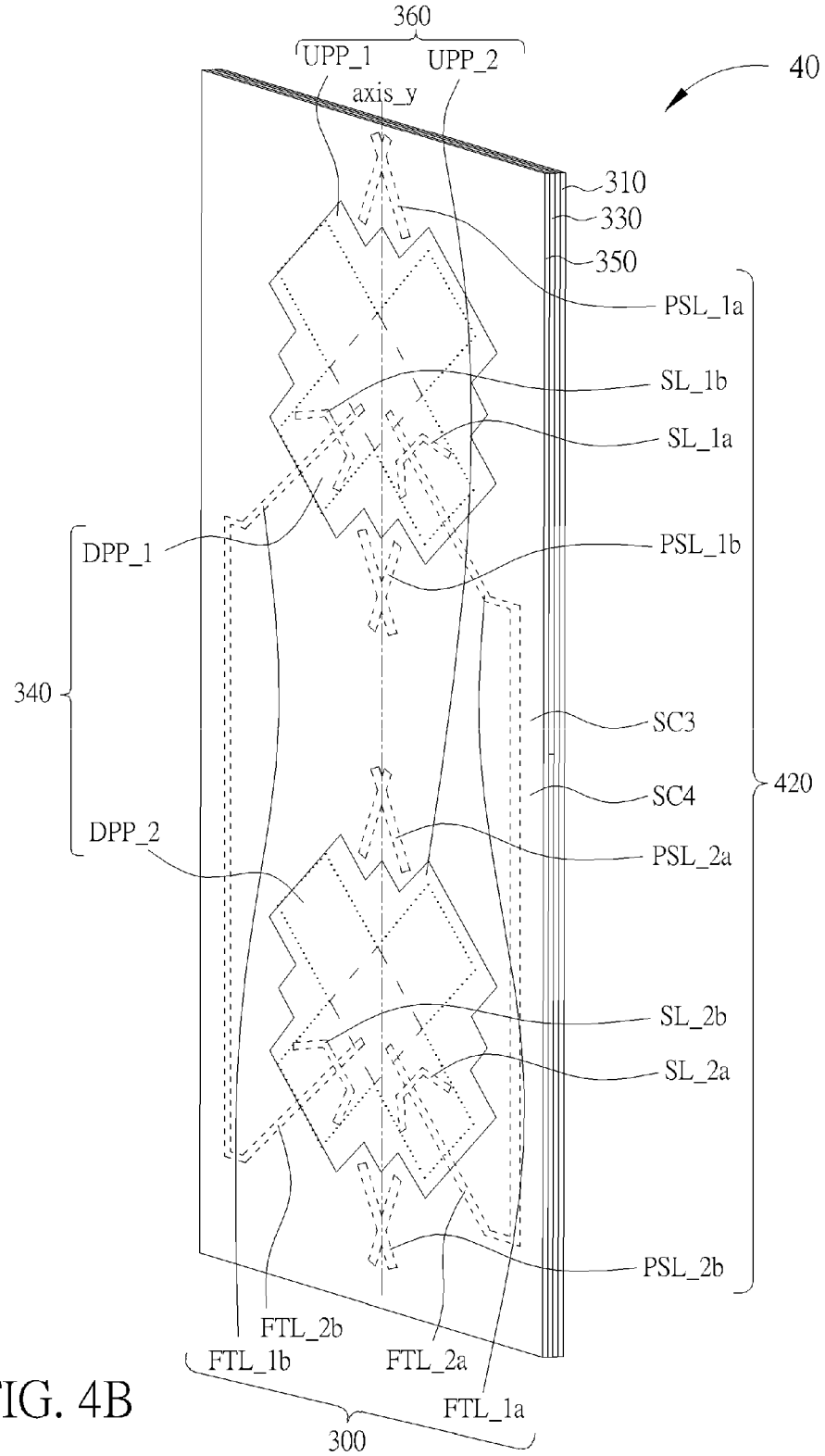
FIG. 4B is a schematic diagram illustrating a perspective view of the complex antenna shown in FIG. 4A.

To further improve common polarization to cross polarization (Co/Cx) value of the complex antenna 30, the structure of the metal grounding plate 320 may be modified. Please refer to FIG. 4A and FIG. 4B. FIG. 4A is a top-view schematic diagram illustrating a complex antenna 40 according to an embodiment of the present invention. FIG. 4B is a schematic diagram illustrating a perspective view of the complex antenna 40. The complex antenna 40 comprises the feeding transmission line layer 300, dielectric layers 310, 330, 350, a metal grounding plate 420 and the planar dual polarization antenna layers 340, 360. In other words, the structure of the complex antenna 40 is similar to that of the complex antenna 30 shown in FIG. 3, and the similar parts are not detailed redundantly. Different from the complex antenna 30, rectangular regions SC3, SC4 of the metal grounding plate 420 further comprise pattern slots PSL_1*a*, PSL_1*b*, PSL_2*a*, PSL_2*b* respectively, which balance the asymmetry due to the uneven quantities between the length L1 and the width W1. The pattern slots PSL_1*a*, PSL_1*b*, PSL_2*a*, PSL_2*b* respectively have the shape of the boomerang shape 20 as shown in FIG. 2, and are symmetric with respect to the centerline CL_1, CL_2 of the patch plates DPP_1, DPP_2, respectively.

In other words, with the array antenna structure, antenna gain of the complex antenna 40 increases. And the width W1 of the rectangular regions SC3, SC4 is shortened to increase beamwidth. In order to balance the asymmetry between the length L1 and the width W1, the rectangular regions SC3, SC4 further respectively comprise the pattern slots PSL_1*a*, PSL_1*b*, PSL_2*a*, PSL_2*b* and thus improve common polarization to cross polarization (Co/Cx) value.

Figure 5A:
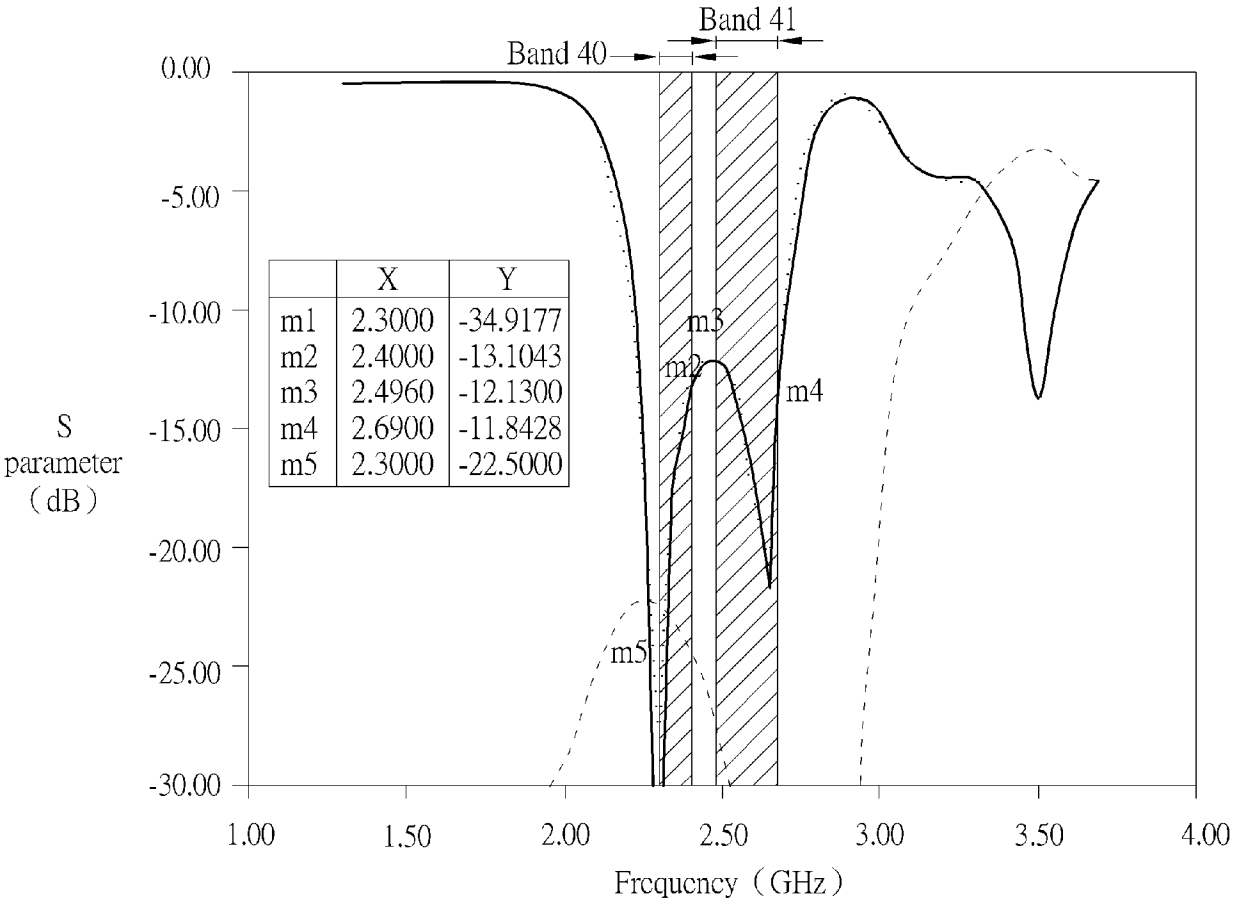
FIG. 5A is a schematic diagram illustrating antenna resonance simulation results of the complex antenna shown in FIG. 4A.
Figure 5B:
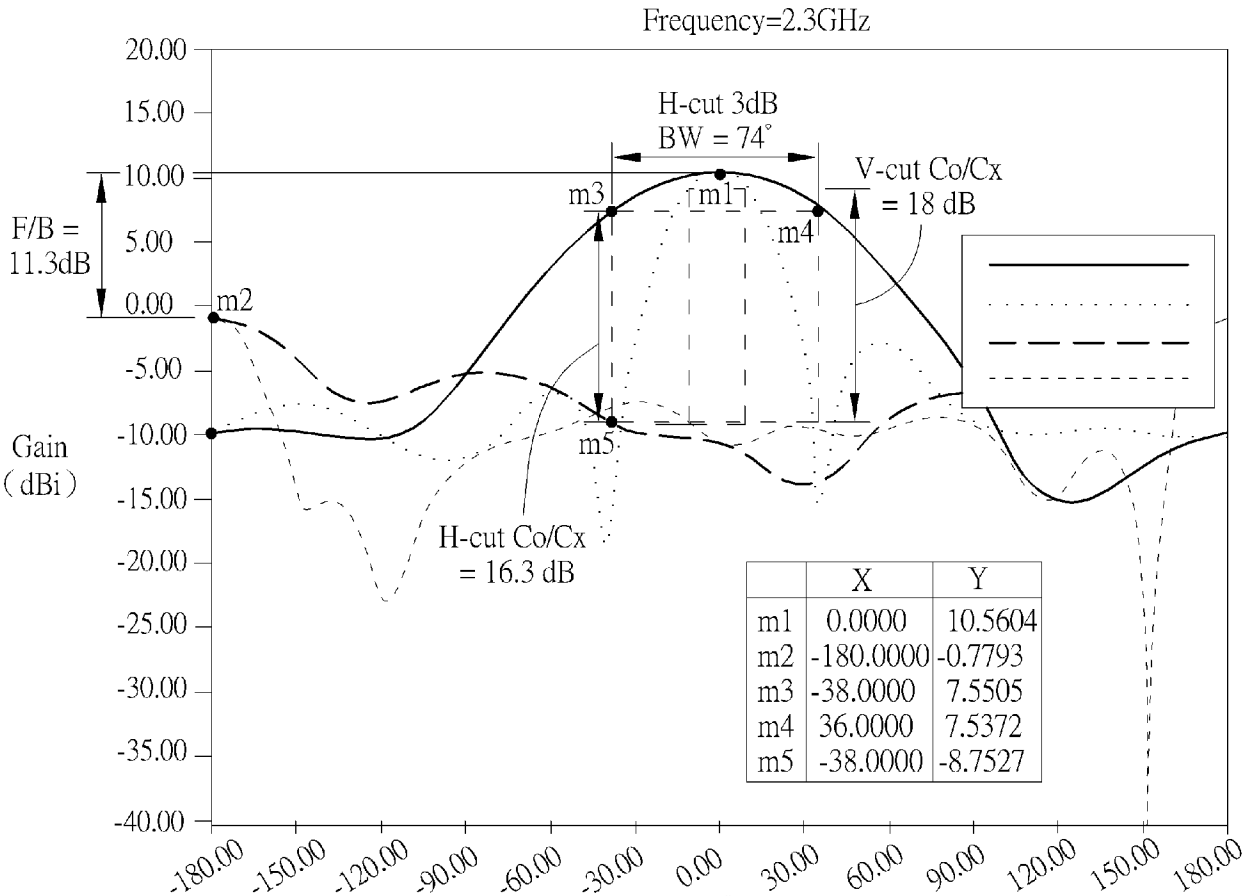
FIGS. 5B to 5E are schematic diagrams illustrating antenna pattern characteristic simulation results of the complex antenna shown in FIG. 4A respectively at 2.3 GHz, 2.4 GHz, 2.496 GHz, 2.69 GHz.
Figure 5C:
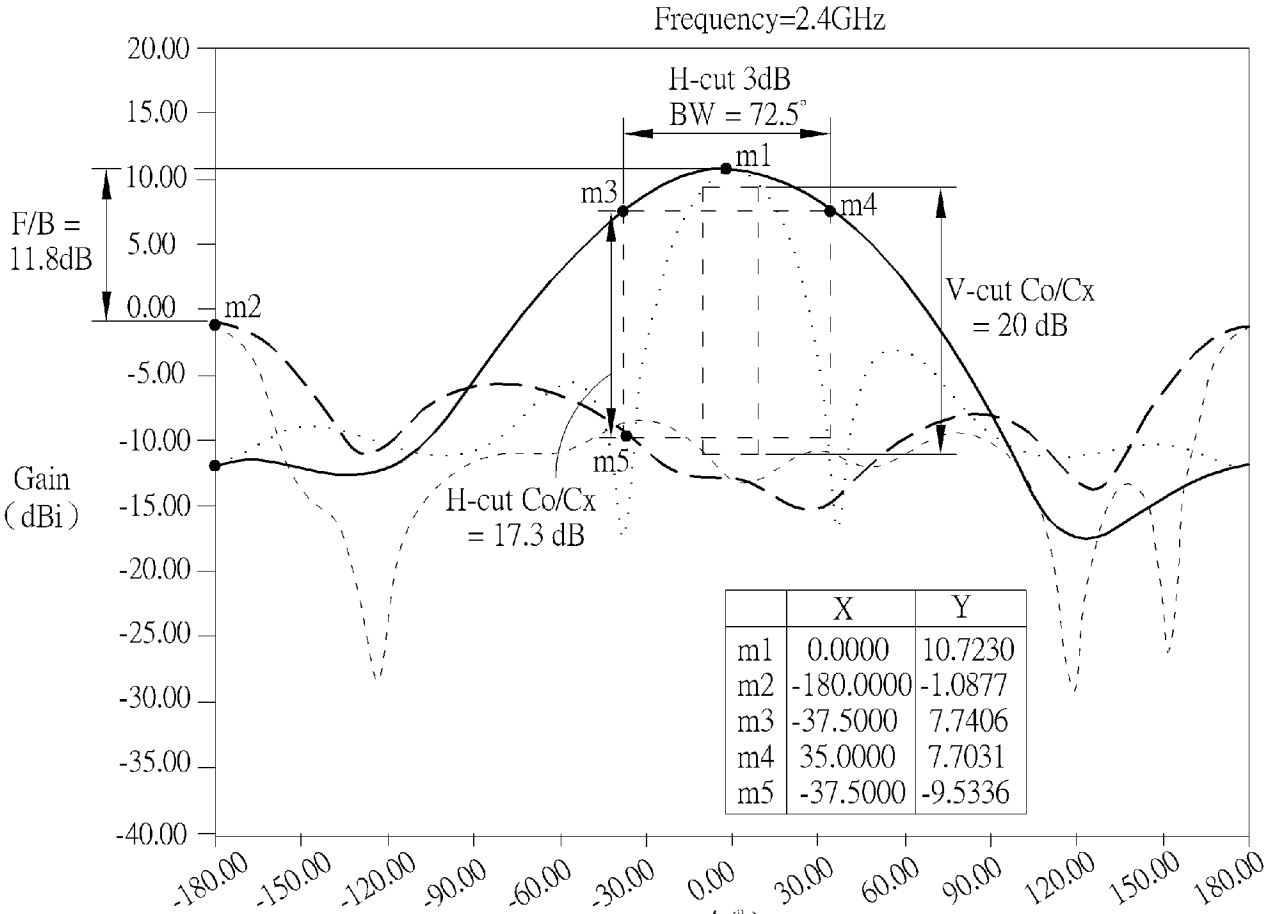
Figure 5D:
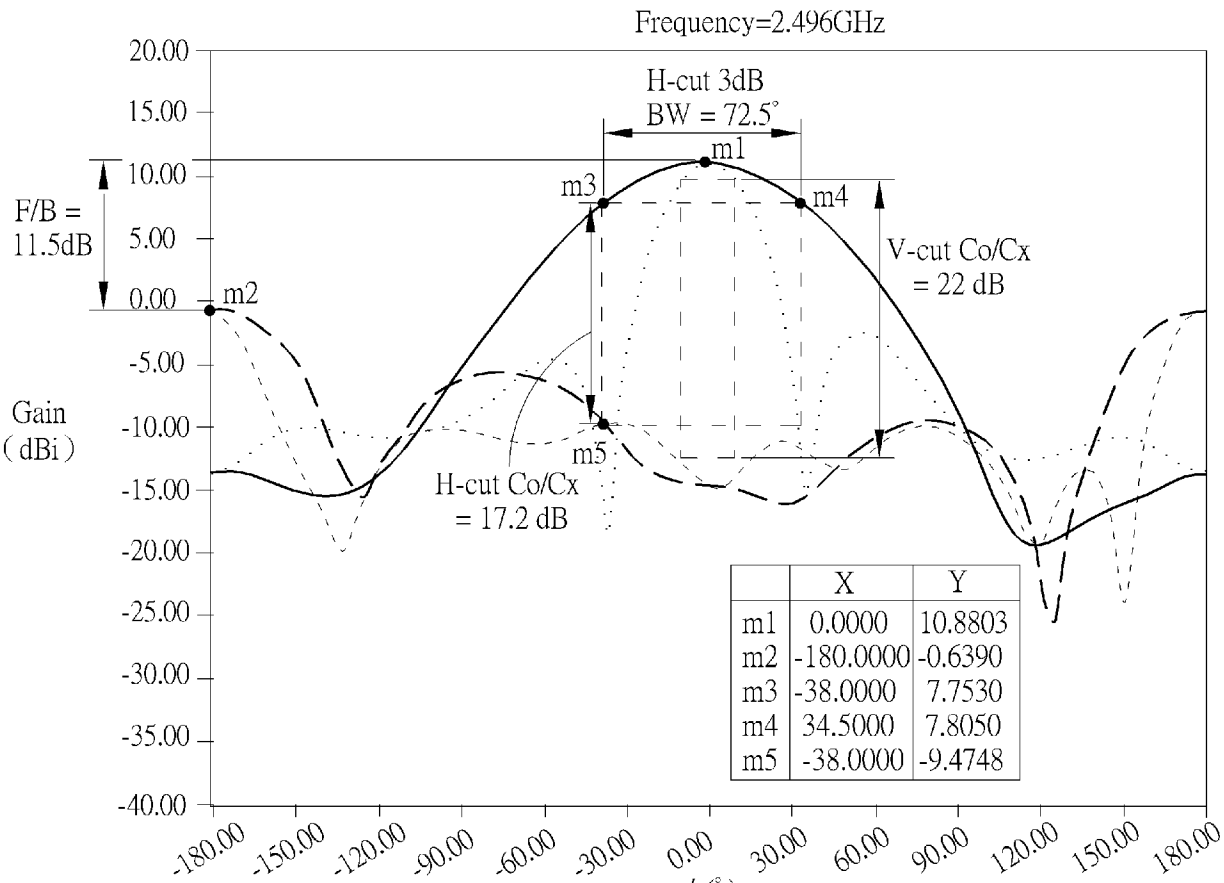
Figure 5E:
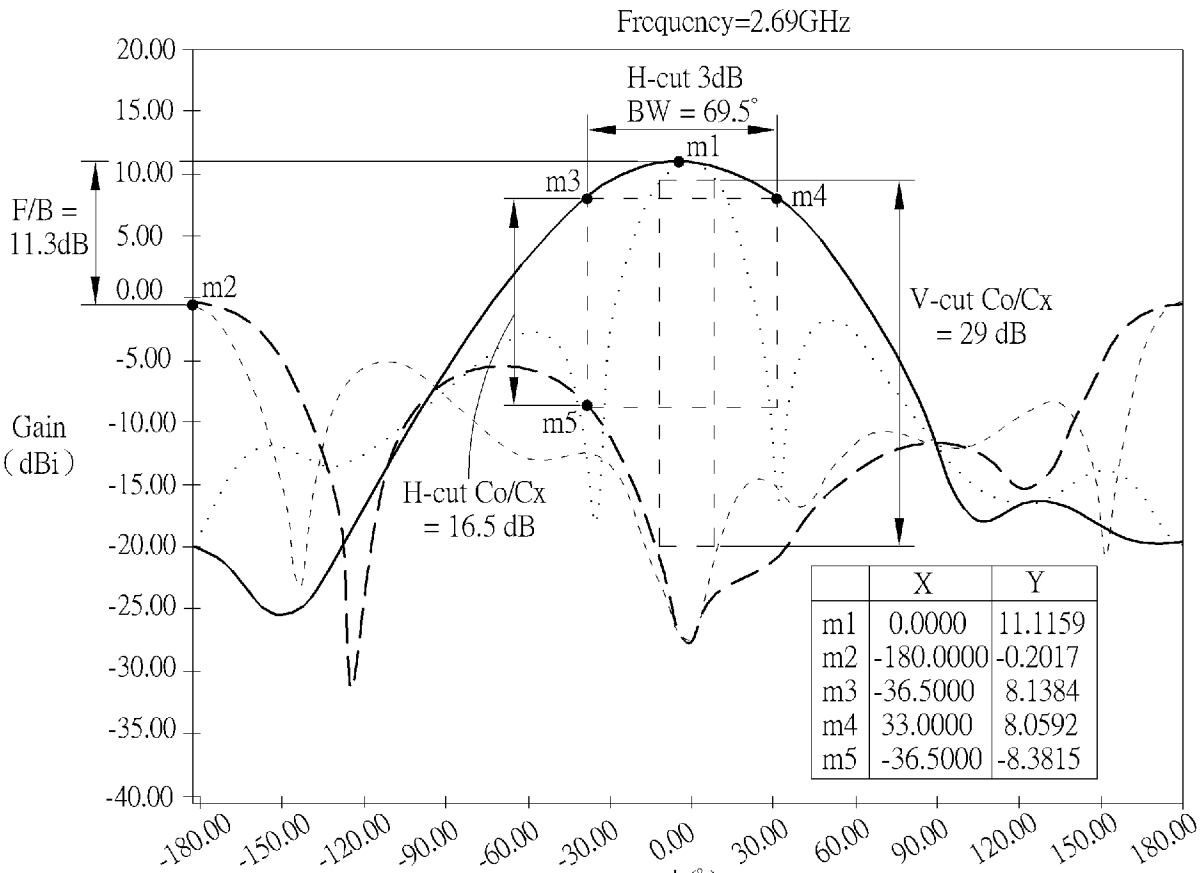
Figure 6A:
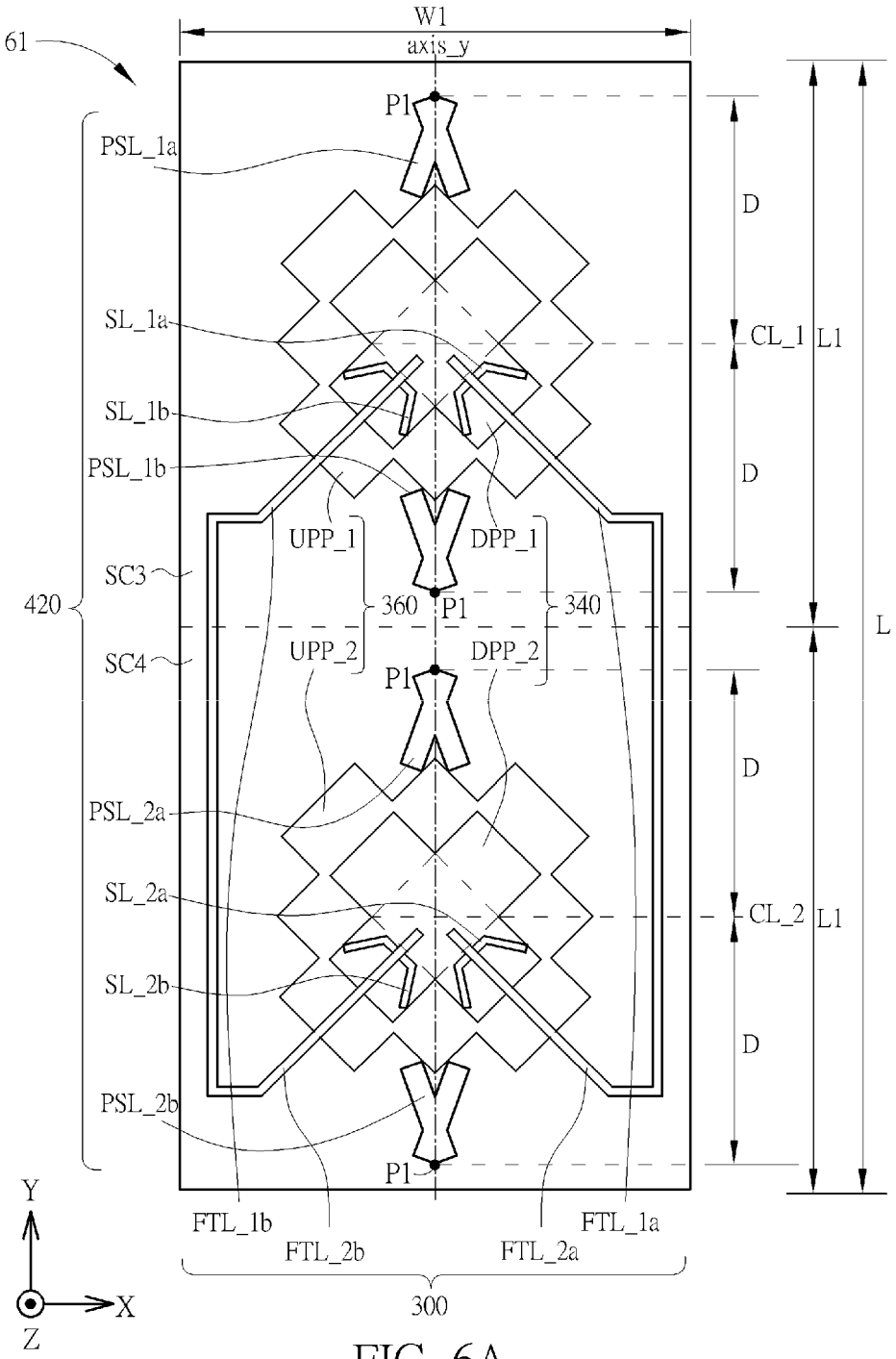
FIGS. 6A to 6F are top-view schematic diagrams illustrating complex antennas according to various embodiments of the present invention.
Figure 6B:
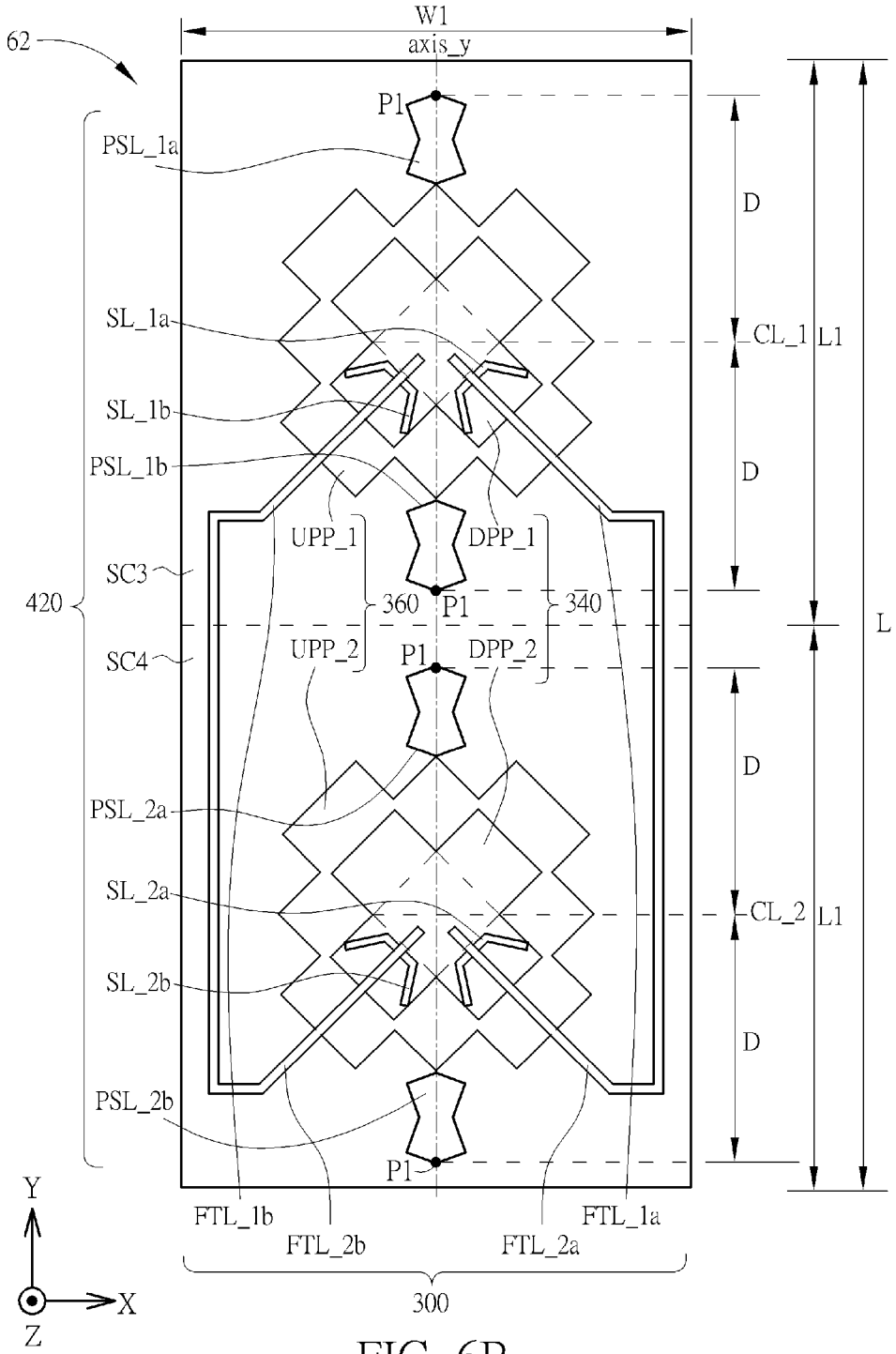
Figure 6C:
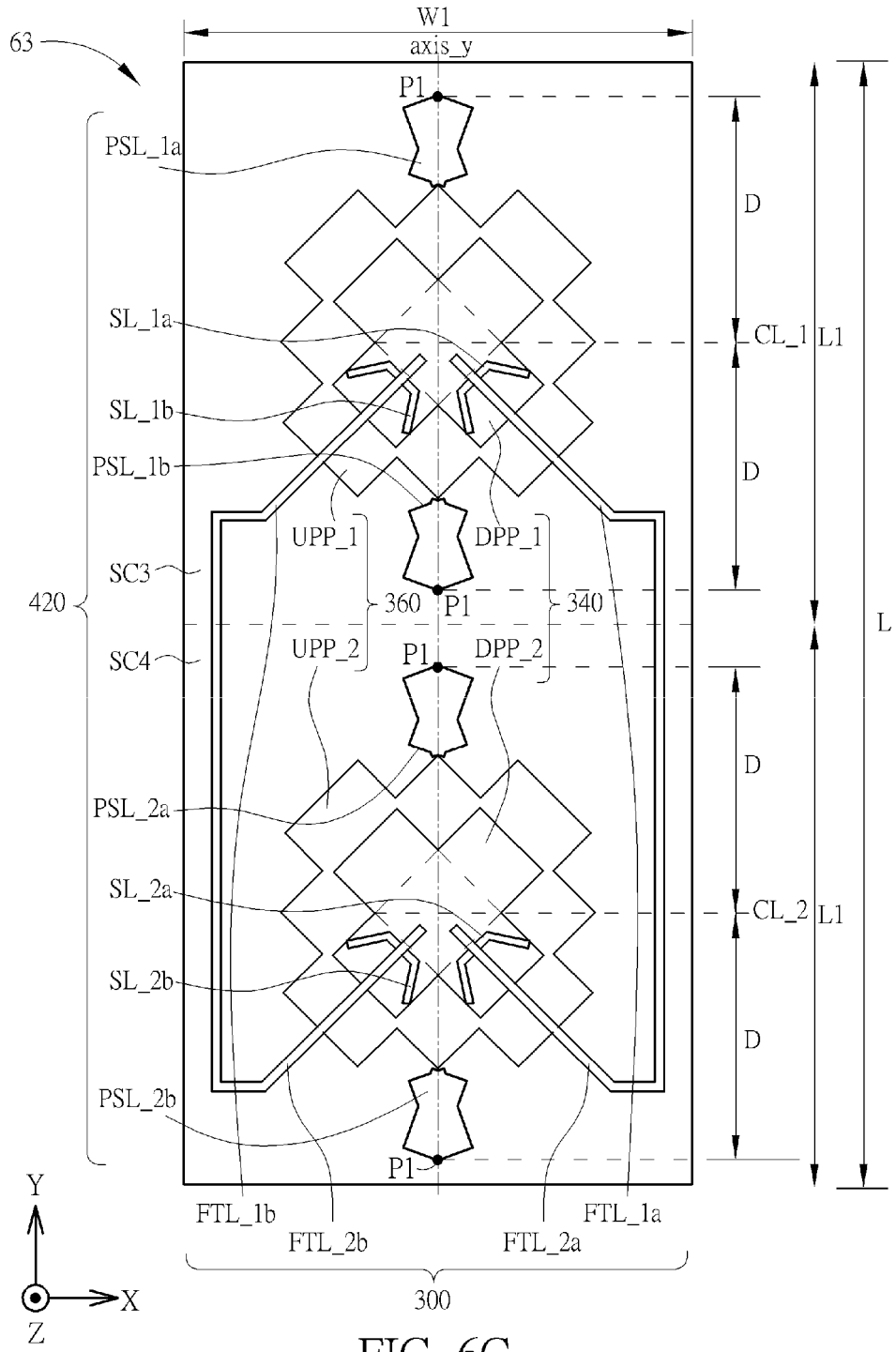
Figure 6D:
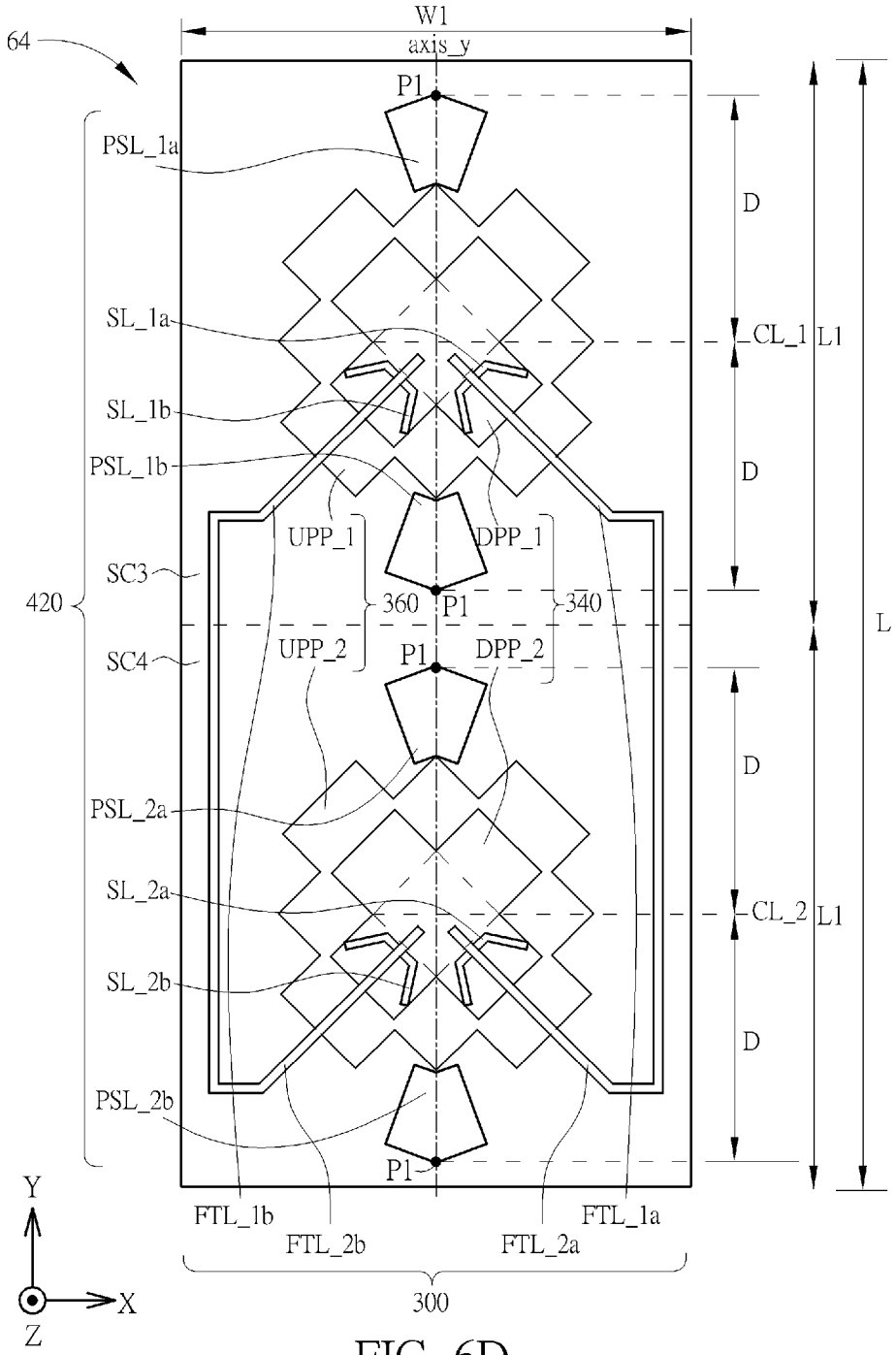
Figure 6E:
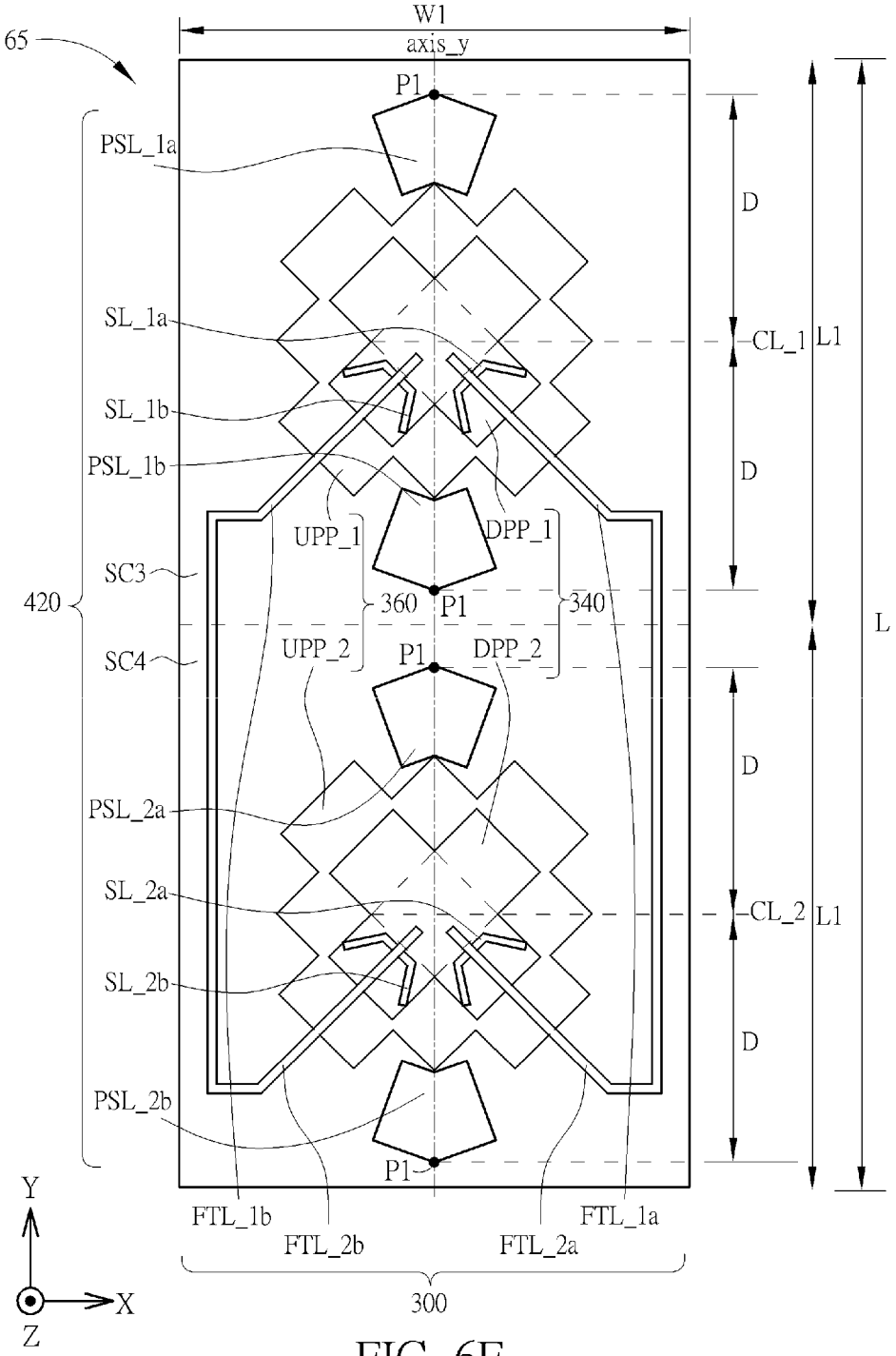
Figure 6F:
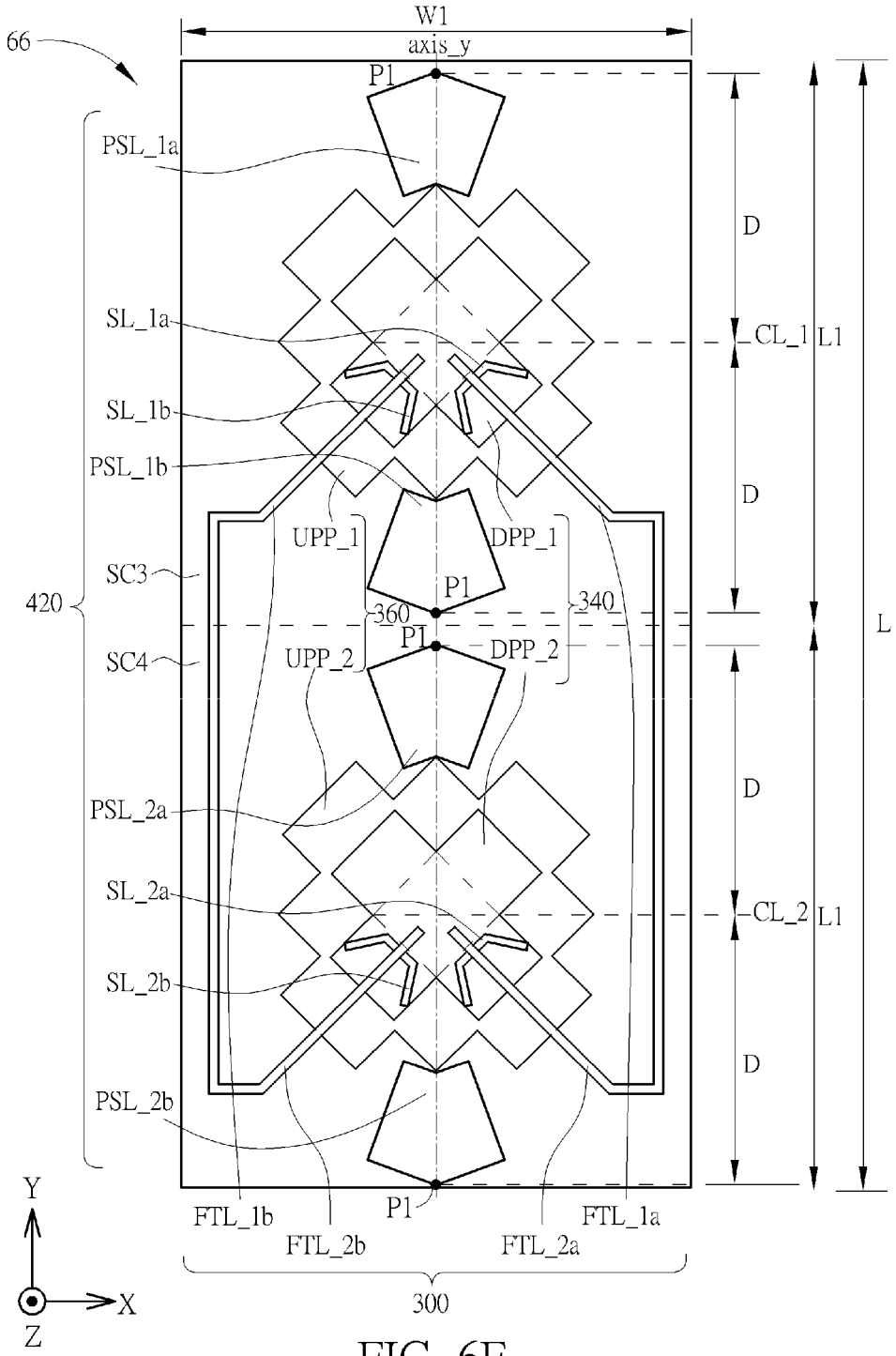

Simulation and measurement may be employed to determine whether the complex antenna 40 meets system requirements. Specifically, FIG. 5A is a schematic diagram illustrating antenna resonance simulation results of the complex antenna 40. In FIG. 5A, dotted and solid lines respectively indicate antenna resonance simulation results for a 45-degree slant polarization and a 135-degree slant polarization of the complex antenna 40, while a dashed line indicates antenna isolation simulation results between a 45-degree slant polarization and a 135-degree slant polarization. It can be seen that, in Band 40 and Band 41, return losses (S11) of a 45-degree slant polarization and a 135-degree slant polarization of the complex antenna 40 have values below −11.8 dB. Furthermore, isolation between a 45-degree slant polarization and a 135-degree slant polarization of the complex antenna 40 is at least 22.5 dB or above. In addition, Table 2 is an antenna characteristic table for the complex antenna 40. FIGS. 5B to 5E are schematic diagrams illustrating antenna pattern characteristic simulation results of the complex antenna 40 respectively at 2.3 GHz, 2.4 GHz, 2.496 GHz, 2.69 GHz. In FIGS. 5B to 5E, common polarization radiation pattern of the complex antenna 40 in horizontal plane (i.e., at 0 degrees) is presented by a solid line, common polarization radiation pattern of the complex antenna 40 in vertical plane (i.e., at 90 degrees) is presented by a dotted line, cross polarization radiation pattern of the complex antenna 40 in horizontal plane is presented by a long dashed line, and cross polarization radiation pattern of the complex antenna 40 in vertical plane is presented by a short dashed line. FIGS. 5B to 5E and Table 2 show that the beamwidth of the complex antenna 40 in horizontal plane is wide and the complex antenna 40 meets LTE wireless communication system requirements for maximum gain and front-to-back (F/B) ratio. Besides, the common polarization to cross polarization (Co/Cx) value is at least 16.3 dB or above.

TABLE 2

| | |
|---|---|
| the total length L of the metal grounding plate (mm) | 200 |
| the width W1 of the metal grounding plate (mm) | 70 |
| maximum gain (dBi) | 10.6-11.1 |
| front-to-back (F/B) ratio (dB) | 11.3-11.8 |
| 3 dB beamwidth in horizontal plane | 69.5°-74.0° |
| common polarization to cross polarization (Co/Cx) value in horizontal plane (dB) | 16.3-17.3 |
| common polarization to cross polarization (Co/Cx) value in vertical plane (dB) | 18-29 |

Please note that the planar dual polarization antenna 10 and the complex antenna 30, 40 are exemplary embodiments of the invention, and those skilled in the art can make alternations and modifications accordingly. For example, portions of the feeding transmission lines 102*a*, 102*b*, FTL_1*a*, FTL_1*b*, FTL_2*a*, FTL_2*b* and the slots 122*a*, 122*b*, SL_1*a*, SL_1*b*, SL_2*a*, SL_2*b* may be modified according to different considerations, which means that degrees of the included angles enclosed by two adjacent portions can be either obtuse or acute angles, length ratios or width ratios may be changed, and the shape and the number of portions may vary. Also, having a shape "substantially conforming to a cross pattern" recited in the present invention relates to the patch plate 140, 160, UPP_1, UPP_2, DPP_1, DPP_2 being formed by two overlapping and intercrossing rectangular patch plates. However, the present invention is not limited thereto, and any patch plate having a shape "substantially conforming to a cross pattern" are within the scope of the present invention. For example, a patch plate extends outside a square side plate; alternatively, a patch plate extends outside a saw-tooth shaped side plate; alternatively, a patch plate further extends outside an arc-shaped side plate; alternatively, edges of a patch plate are rounded. The dielectric layers 110, 130, 150, 310, 330, 350 can be made of various electrically isolation materials such as air. The patch plate 160, the planar dual polarization antenna layer 360 and the dielectric layer 150, 350 in fact depend on bandwidth requirements and may therefore be optional. The complex antennas 30, 40 are 1×2 array antennas, but not limited thereto and can be 1×3, 2×4 or m×n array antennas.

Besides, the length L2 of the rectangle 200*a* of the boomerang shape 20 as shown in FIGS. 2, 4A, 4B is 25 mm, the width W2 is 2.5 mm, the distance D between the pivot vertex P1 of the boomerang shape 20 and the centerline (e.g., the centerline CL_1 or the centerline CL_2) is 47.449 mm; However, the present invention is not limited to this and can be appropriately adjusted according different system requirements. For example, please refer to FIGS. 6A to 6F and Table 3. FIGS. 6A to 6F are top-view schematic diagrams illustrating complex antennas 61 to 66 according to various embodiments of the present invention. Table 3 is an antenna characteristic table for the complex antennas 61 to 66. As can be seen from Table 3, by properly adjusting the size of the pattern slot of the complex antennas 61 to 66, antenna characteristics are changed and common polarization to cross polarization (Co/Cx) value can be greater than 15.8 dB.

TABLE 3

| | the complex antenna 61 | the complex antenna 62 | the complex antenna 63 | the complex antenna 64 | the complex antenna 65 | the complex antenna 66 |
|---|---|---|---|---|---|---|
| | 200 | 200 | 200 | 200 | 200 | 200 |
| | 70 | 70 | 70 | 70 | 70 | 70 |
| | 25 | 20 | 20 | 20 | 15 | 20 |
| | 5 | 7.5 | 10 | 12.5 | 15 | 17.5 |
| | 47.449 | 44.975 | 44.975 | 44.975 | 42.483 | 44.975 |
| | 10.5-11.1 | 10.5-11.2 | 10.5-11.1 | 10.5-11.1 | 10.6-11.0 | 10.4-10.9 |
| | 11.5-12.3 | 11.0-11.7 | 11.2-11.8 | 11.4-12.0 | 11.2-11.7 | 11.2-12.6 |
| | 70.5°-75.0° | 69.5°-74.0° | 69.5°-73.5° | 69.5°-75.0° | 69.5°-73.5° | 69.5°-74.0° |
| common polarization to cross polarization (Co/Cx) value in horizontal plane (dB) | 15.8-18.7 | 16.4-17.6 | 16.6-17.8 | 16.1-19.2 | 16.1-16.8 | 16.4-21.7 |
| common polarization to cross polarization (Co/Cx) value in vertical plane (dB) | 23-35 | 19-31 | 20-31 | 23-31 | 18-27 | 24-31 |

Figure 7:
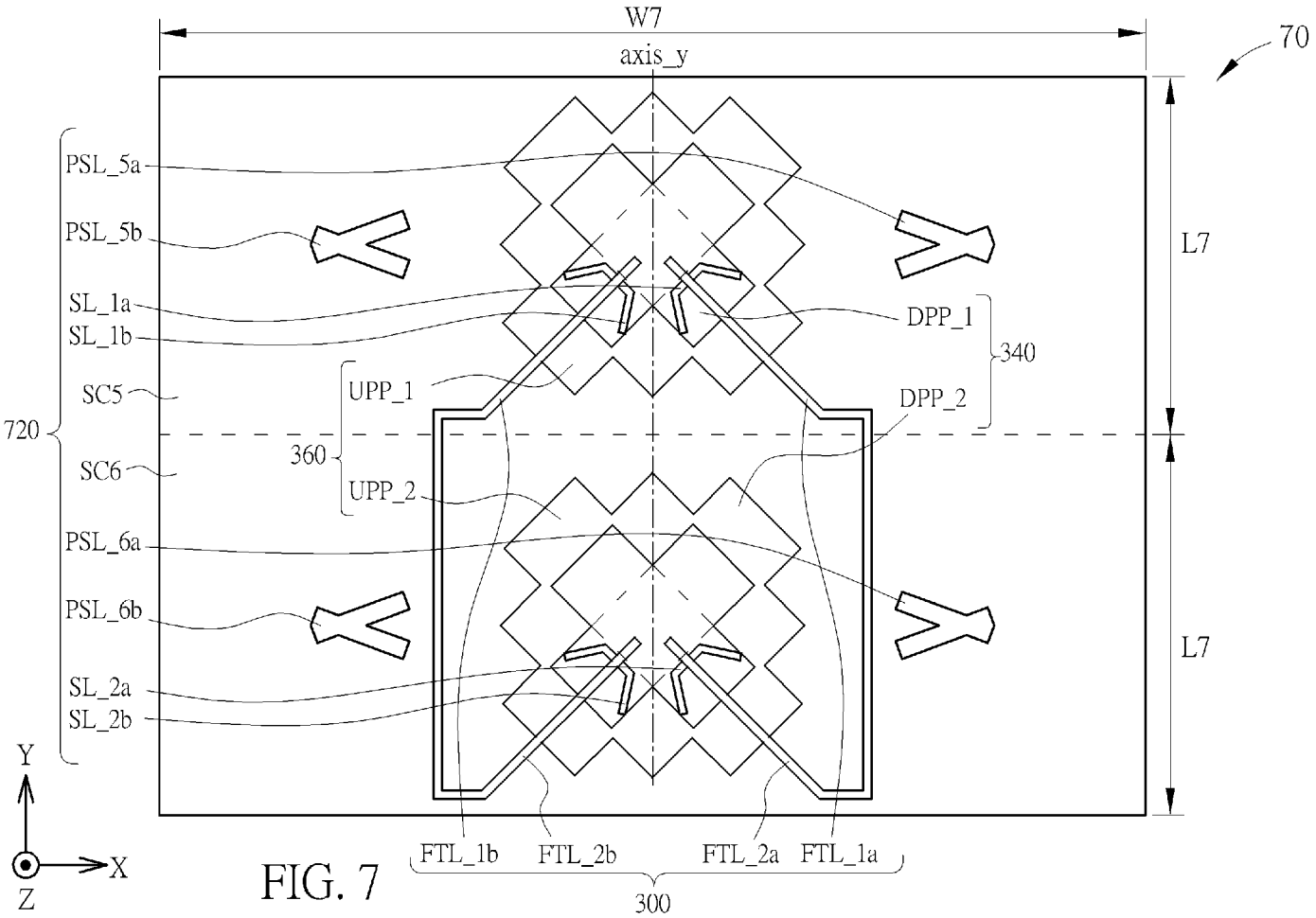
FIG. 7 is a top-view schematic diagram illustrating a complex antenna according to an embodiment of the present invention.

On the other hand, to reduce the beamwidth in horizontal plane (i.e., the xz plane), the width of the metal grounding plate along the direction x may be enlarged. FIG. 7 is a top-view schematic diagram illustrating a complex antenna 70 according to an embodiment of the present invention. The structure of the complex antenna 70 is substantially similar to that of the complex antenna 40, and the similar parts are not detailed redundantly. Different from the complex antenna 40, the width W7 of the metal grounding plate 720 along the direction x increases to make the antenna pattern in horizontal plane converge. Therefore, the length L7 of rectangular regions SC5, SC6 of the metal grounding plate 720 along the symmetry axis axis_y is less than the width W7 of rectangular regions SC5, SC6 along the direction x. The rectangular regions SC5, SC6 of the metal grounding plate 720 further comprises pattern slots PSL_5*a*, PSL_5*b*, PSL_6*a*, PSL_6*b* to balance the asymmetry of the length L7 and the width W7.

To sum up, by adjusting the ratio of the length to the width of the rectangular regions of the metal grounding plate, beamwidth increases. In order to balance the asymmetry of the length and the width, the metal grounding plate comprises pattern slots, which improves common polarization to cross polarization (Co/Cx) value.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A planar dual polarization antenna for receiving and transmitting at least one radio signal, comprising:

a first patch plate;

a metal grounding plate comprising a first pattern slot and a second pattern slot, wherein a first rectangle and a second rectangle enclosing an angle constitute a shape of the first pattern slot, the first rectangle and the second rectangle meet at a pivot vertex, and the first pattern slot and the second pattern slot are symmetric with respect to a centerline of the first patch plate; and a first dielectric layer disposed between the first patch plate and the metal grounding plate.

2. The planar dual polarization antenna of claim 1, wherein a length of the metal grounding plate along a symmetry axis is not equal to a width of the metal grounding plate to adjust beamwidth, and the symmetry axis is perpendicular to the centerline.

3. The planar dual polarization antenna of claim 2, wherein the first pattern slot and the second pattern slot are respectively symmetric with respect to the symmetry axis.

4. The planar dual polarization antenna of claim 1, wherein the first patch plate has a shape substantially conforming to a cross pattern.

5. The planar dual polarization antenna of claim 2, further comprising:

a feeding transmission line layer comprising a first feeding transmission line and a second feeding transmission line, the first feeding transmission line and the second feeding transmission line are symmetric with respect to the symmetry axis; and a second dielectric layer disposed between the feeding transmission line layer and the metal grounding plate.

6. The planar dual polarization antenna of claim 5, wherein the metal grounding plate comprises a first slot and a second slot, the first slot and the second slot are symmetric with respect to the symmetry axis, the first slot and the first feeding transmission line generate coupling effects, and the second slot and the second feeding transmission line generate coupling effects to increase bandwidth of the planar dual polarization antenna.

7. The planar dual polarization antenna of claim 1, further comprising a second patch plate disposed above the first patch plate and electrically isolated from the first patch plate.

8. A complex antenna for receiving and transmitting at least one radio signal, comprising:

a first planar dual polarization antenna layer comprising a plurality of first patch plates;

a metal grounding plate comprising a plurality of rectangular regions, wherein each rectangular region of the plurality of rectangular regions is disposed corresponding to one of the plurality of first patch plates, each rectangular region of the plurality of rectangular regions comprises a first pattern slot and a second pattern slot, a first rectangle and a second rectangle enclosing an angle constitute a shape of the first pattern slot, the first rectangle and the second rectangle meet at a pivot vertex, and the first pattern slot and the second pattern slot are symmetric with respect to a centerline of the first patch plate; and a first dielectric layer disposed between the first planar dual polarization antenna layer and the metal grounding plate.

9. The complex antenna of claim 8, wherein a length of each rectangular region of the plurality of rectangular regions along a symmetry axis is not equal to a width of each rectangular region of the plurality of rectangular regions to adjust beamwidth, and the symmetry axis is perpendicular to the centerline of the first patch plate corresponding to each rectangular region of the plurality of rectangular regions.

10. The complex antenna of claim 8, wherein the plurality of first pattern slots and the plurality of second pattern slots are respectively symmetric with respect to the symmetry axis.

11. The complex antenna of claim 8, wherein each first patch plate of the plurality of first patch plates has a shape substantially conforming to a cross pattern.

12. The complex antenna of claim 9, further comprising:

a feeding transmission line layer comprising a plurality of first feeding transmission lines and a plurality of second feeding transmission lines, wherein each first feeding transmission line of the plurality of first feeding transmission lines and each second feeding transmission line of the plurality of second feeding transmission lines are disposed corresponding to one of the plurality of first patch plates, and the first feeding transmission lines and the second feeding transmission lines are symmetric with respect to the symmetry axis; and a second dielectric layer, disposed between the feeding transmission line layer and the metal grounding plate.

13. The complex antenna of claim 12, wherein the metal grounding plate comprises a plurality of first slots and a plurality of second slots, each first slot of the plurality of first slots and each second slot of the plurality of second slots are disposed corresponding to one of the plurality of first patch plates, the plurality of first slots and the plurality of second slots are respectively symmetric with respect to the symmetry axis, each first slot of the plurality of first slots and the first feeding transmission line corresponding to the first slot generate coupling effects, each second slot of the plurality of second slots and the second feeding transmission line corresponding to the second slot generate coupling effects to increase bandwidth of the complex antenna.

14. The complex antenna of claim 8, further comprising a second planar dual polarization antenna layer, wherein the second planar dual polarization antenna layer comprises a plurality of second patch plates, and the plurality of second patch plates are respectively disposed above the plurality of first patch plates correspondingly and electrically isolated from the plurality of first patch plates.

* * * * *